US008987981B2

(12) United States Patent
Imai

(10) Patent No.: US 8,987,981 B2
(45) Date of Patent: Mar. 24, 2015

(54) SPARK PLUG

(71) Applicant: NGK Spark Plug Co., Ltd., Nagoya (JP)

(72) Inventor: Susumu Imai, Inuyama (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 14/317,564

(22) Filed: Jun. 27, 2014

(65) Prior Publication Data

US 2015/0002011 A1 Jan. 1, 2015

(30) Foreign Application Priority Data

Jun. 28, 2013 (JP) ..... 2013-137463

(51) Int. Cl.

| | |
|---|---|
| ***H01T 13/20*** | (2006.01) |
| ***H01T 13/32*** | (2006.01) |
| ***H01T 13/39*** | (2006.01) |
| ***H01T 13/16*** | (2006.01) |

(52) U.S. Cl.

CPC ..... *H01T 13/32* (2013.01); *H01T 13/39* (2013.01); *H01T 13/16* (2013.01)

USPC ..... 313/142; 313/141

(58) Field of Classification Search

CPC ..... H01T 13/32

USPC ..... 313/118–145

See application file for complete search history.

(56) References Cited

U.S. PATENT DOCUMENTS

| | | | | |
|---|---|---|---|---|
| 7,605,526 | B2 * | 10/2009 | Ishinada et al. | 313/142 |
| 2003/0071552 | A1 * | 4/2003 | Teramura et al. | 313/143 |
| 2014/0210334 | A1 * | 7/2014 | Kowalski et al. | 313/141 |

FOREIGN PATENT DOCUMENTS

| | | | |
|---|---|---|---|
| JP | 05-159856 | A | 6/1993 |
| JP | 05-159857 | A | 6/1993 |
| JP | 2001-351761 | A | 12/2001 |

* cited by examiner

*Primary Examiner* — Anne Hines

(74) *Attorney, Agent, or Firm* — Leason Ellis LLP

(57) ABSTRACT

A sparkplug includes a ground electrode forming a gap with a front end surface of the center electrode. A front end portion of the ground electrode includes an opposed surface facing the center electrode, and a pair of tapered surfaces sandwiching the opposed surface. A shortest distance between the center electrode and a boundary formed by the opposed surface and the tapered surface is equal to or less than 1.2 times a distance of the gap. At least a part of a cross section of the core portion is disposed in a region at a front side of the straight line that passes a rear end of a line segment corresponding to the tapered surface and is vertical to the line segment. A shortest distance between the line segment and the cross section of the core portion is 0.2 mm or more and 1.5 mm or less.

8 Claims, 7 Drawing Sheets

SPARK PLUG

This application claims the benefit of Japanese Patent Application No. 2013-137463 filed with the Japan Patent Office on Jun. 28, 2013, the entire content of which is hereby incorporated by reference.

FIELD OF THE INVENTION

This disclosure relates to a spark plug.

BACKGROUND OF THE INVENTION

Conventionally, a spark plug is employed for an internal combustion engine. The spark plug includes, for example, a center electrode, and a ground electrode. The center electrode and the ground electrode form a gap to generate spark. When the ground electrode absorbs heat, an action to extinguish a flame (also referred to as a flame quenching) occurs. To reduce this, a technique that tapers off a front end portion of the ground electrode has been proposed.

Related documents of such spark plug include, for example, Japanese patent application laid-open number 05-159856, Japanese patent application laid-open number 05-159857, and Japanese patent application laid-open number 2001-351761.

SUMMARY OF THE INVENTION

A sparkplug includes: a center electrode extending in an axial direction; an insulator with an axial hole extending in the axial direction, the center electrode being disposed to be inserted into the axial hole; a metal shell disposed at an outer circumference of the insulator; and a ground electrode that electrically connects to the metal shell, the ground electrode forming a gap with a front end surface of the center electrode. In this spark plug, the ground electrode includes a rod-shaped main body portion, the main body portion including a base material and a core portion, the base material forming at least a part of a surface of the ground electrode, the core portion being buried in the base material and having a higher thermal conductivity than the base material.

A front end portion of the main body portion of the ground electrode is disposed at a position facing a front end surface of the center electrode.

The front end portion of the main body portion includes a tapered front end portion, the tapered front end portion including an opposed surface and a pair of tapered surfaces, the opposed surface being a surface facing the center electrode, the tapered surfaces being configured to sandwich the opposed surface.

When the front end surface of the center electrode is projected along the axial direction, at least a part of the tapered end portion is disposed in a range overlapping the projected front end surface of the center electrode.

A shortest distance between the center electrode and a boundary formed by the opposed surface and the tapered surface is equal to or less than 1.2 times a distance of the gap.

a perpendicular cross section of the ground electrode includes a front end of the core portion and perpendicular to the axial direction, wherein at least a part of a cross section of the core portion is disposed in a region at a front end side of a straight line that passes a rear end of a line segment corresponding to the tapered surface and is vertical to the line segment, and a shortest distance between the line segment and the cross section of the core portion is 0.2 mm or more to 1.5 mm or less.

BRIEF DESCRIPTION OF DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Figure 1:
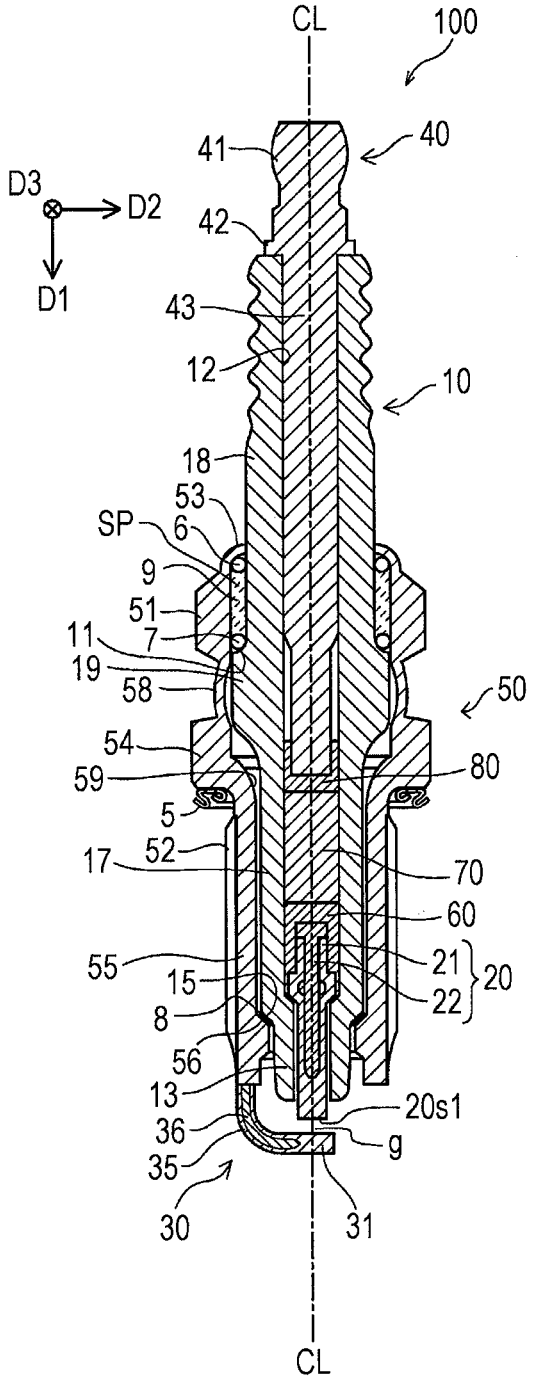
FIG. 1 is a sectional view of a spark plug according to a first embodiment.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

When the front end portion of the ground electrode is tapered off, although ignitability is improved, durability of the ground electrode may be degraded. For example, when the front end portion of the ground electrode is tapered off, the front end portion is thinned. In view of this, a volume of the ground electrode is decreased. Therefore, a temperature of the ground electrode is likely to be high. High temperature of the ground electrode may easily cause the ground electrode to be worn due to, for example, oxidation of the surface of ground electrode.

An object of this disclosure is to achieve improvement of ignitability and improvement of durability of the ground electrode.

This disclosure can be achieved as the following application examples.

Application Example 1

A sparkplug includes: a center electrode extending in an axial direction; an insulator with an axial hole extending in the axial direction, the center electrode being disposed to be inserted into the axial hole; a metal shell disposed at an outer circumference of the insulator; and a ground electrode that electrically connects to the metal shell, the ground electrode forming a gap with a front end surface of the center electrode, wherein the ground electrode includes a rod-shaped main body portion, the main body portion including a base material and a core portion, the base material forming at least a part of a surface of the ground electrode, the core portion being buried in the base material and having a higher thermal conductivity than the base material, a front end portion of the main body portion of the ground electrode is disposed at a position facing a front end surface of the center electrode, the front end portion of the main body portion includes a tapered front end portion, the tapered front end portion including an opposed surface and a pair of tapered surfaces, the opposed surface being a surface facing the center electrode, the tapered surfaces being configured to sandwich the opposed surface, when the front end surface of the center electrode is projected along the axial direction, at least a part of the tapered end portion is disposed in a range overlapping the projected front end surface of the center electrode, a shortest distance between a boundary between the opposed surface at a surface of the tapered end portion and the tapered surface, and the center electrode is equal to or less than 1.2 times a distance of the gap, and a perpendicular cross section of the ground electrode includes a front end of the core portion and perpendicular to the axial direction, wherein at least a part of a cross section of the core portion is disposed in a region at a front end side with respect to the straight line, the straight line being vertical to the line segment, the straight line passing a rear end of a line segment corresponding to the tapered surface on the perpendicular cross section, and a shortest distance between the line segment corresponding to the tapered surface and the cross section of the core portion is 0.2 mm or more to 1.5 mm or less.

With this constitution, on the cross section including the front end of the core portion and is perpendicular to the axial direction, at least a part of the cross section of the core portion is disposed in the region at the front end side with respect to the straight line vertical to the line segment. The straight line passes the rear end of the line segment corresponding to the tapered surface. The shortest distance between the line segment corresponding to the tapered surface and the cross section of the core portion is 0.2 mm or more and 1.5 mm or less. This allows achieving improvement of ignitability and improvement of durability of the ground electrode.

Application Example 2

The spark plug according to application example 1, wherein at least a part including the front end of the core portion is formed of a material with a melting point of 1350 degrees Celsius or more.

This constitution allows reducing damage to the ground electrode.

Application Example 3

The spark plug according to application example 2, wherein the core portion includes a first core portion and a second core portion, the first core portion having a higher thermal conductivity than the base material, the second core portion being disposed between the base material and the first core portion, the second core portion having a higher thermal conductivity than the first core portion, on the perpendicular cross section, a cross-sectional structure of a front end side of the ground electrode is a two-layered structure of the first core portion and the base material, a cross-sectional structure of a rear end side of the ground electrode being a three-layered structure of the first core portion, the second core portion, and the base material.

With this constitution, disposing the first core portion and the second core portion with higher thermal conductivity than the first core portion improves thermal conductivity of the ground electrode. This allows reducing wear of the ground electrode. The second core portion is not disposed at the front end side of the ground electrode. Accordingly, damage to the ground electrode due to a temperature rise of the second core portion can be suppressed.

Application Example 4

The spark plug according to any one of application example 1 to 3, wherein the ground electrode further includes a noble metal tip, the noble metal tip facing a front end surface of the center electrode.

This constitution allows suppressing the gap to be widened.

Application Example 5

The spark plug according to application example 4, wherein the noble metal tip is secured to the base material by laser beam welding, the main body portion of the ground electrode includes a fusion portion, the fusion portion including a constituent of the base material and a constituent of the noble metal tip, a dividing cross section that is perpendicular to the opposed surface has a line that uniformly divides the opposed surface into two, the line extending on the opposed surface in a cross section of the ground electrode along a longitudinal direction of the ground electrode, wherein among straight lines perpendicular to a direction where the opposed surface extends and overlap a cross section of the fusion portion, a straight line at a most front end side is referred to as a first straight line and a straight line at a rearmost end side is referred to as a second straight line, an area of the cross section of the fusion portion is referred to as a first area S1, on a cross section of the main body portion of the ground electrode, an area of a part sandwiched between the first straight line and the second straight line is referred to as a second area S2, an area ratio S1/S2 is less than 1/3, a cross section of the core portion extends to a front end side of the ground electrode with respect to the second straight line, and the cross section of the core portion is away from a cross section of the fusion portion.

With this constitution, compared with the case where the ratio S1/S2 is 1/3 or more (that is, the area of cross section of the fusion portion is comparatively large), degrade of thermal conductivity of the ground electrode can be suppressed. Since the core portion is away from the fusion portion, degrade of a sealing strength of the noble metal tip and the base material can be suppressed.

Application Example 6

The spark plug according to application example 4, wherein the noble metal tip is secured to the base material by laser beam welding, the main body portion of the ground electrode includes a fusion portion, the fusion portion including a constituent of the base material and a constituent of the noble metal tip, a dividing cross section that is perpendicular to the opposed surface has a line that uniformly divides the opposed surface into two, the line extending the opposed surface in a cross section of the ground electrode along a longitudinal direction of the ground electrode, wherein among straight lines perpendicular to a direction where the opposed surface extends and overlap a cross section of the fusion portion, a straight line at a most front end side is referred to as a first straight line and a straight line at a rearmost end side is referred to as a second straight line, an area of the cross section of the fusion portion is referred to as a first area S1, on a cross section of the main body portion of the ground electrode, an area of a part sandwiched between the first straight line and the second straight line is referred to as a second area S2, an area ratio S1/S2 is 1/3 or more, and a cross section of the core portion contacts the cross section of the fusion portion.

With this constitution, compared with the case where the ratio S1/S2 is less than 1/3 (that is, the area of cross section of the fusion portion is comparatively small), degrade of the sealing strength of the noble metal tip and the base material can be suppressed. Since the core portion contacts the fusion portion, degrade of thermal conductivity of the ground electrode can be suppressed.

This disclosure can be achieved by various aspects. For example, this disclosure can be achieved by an aspect such as a spark plug and an internal combustion engine mounting the spark plug.

A. First Embodiment

A1. Constitution of Spark Plug

FIG. 1 is a sectional view of a spark plug 100 according to a first embodiment. The illustrated line CL indicates a central axis of the spark plug 100. Hereinafter, a central axis CL is also referred to as an "axis line CL" and a direction parallel to the central axis CL is also referred to as an "axial direction. "A radial direction of a circle placing the central axis CL as a center is also simply referred to as a "radial direction. A circumferential direction of the circle placing the central axis CL as the center is also referred to as a "circumferential direction." A first direction D1 in the drawing is parallel to the axis line CL. As described later, a center electrode 20 and a ground electrode 30, which form a spark gap g (also simply referred to as a "gap g") form an end portion at the first direction D1 side of the spark plug 100. Hereinafter, such first direction D1 side is also referred to as "a front end side of the spark plug 100 (or simply referred to as a "front end side")". The opposite side to the first direction D1 is also referred to as a "rear end side of the spark plug 100 (or simply referred to as a "rear end side")". A second direction D2 and a third direction D3 in the drawing are vertical to one another. Both directions are vertical to the first direction D1. Hereinafter, the first direction D1 is also simply referred to as a "+D1 direction" and the direction opposite to the first direction D1 is also simply referred to as a "−D1 direction". Similarly, "+" or "−" sign is employed for other directions to specify the directions. The +D1 direction side is also simply referred to as a "+D1 side" and the −D1 direction side is also simply referred to as a "−D1 side." This is similarly applicable to other direction sides.

The spark plug 100 includes an insulator 10, the center electrode 20, the ground electrode 30, a terminal metal fitting 40, a metal shell 50, a conductive seal 60, a resistor 70, a conductive seal 80, a front end side packing 8, a talc 9, a first rear end side packing 6, and a second rear end side packing 7.

The insulator 10 is an approximately cylindrically-shaped member with a through hole 12 (also referred to as an "axial hole 12"). The through hole 12 extends along the central axis CL and passes through the inside of the insulator 10. The insulator 10 is formed by sintering alumina (other insulating materials can also be employed). The insulator 10 includes a nose portion 13, a first-outer-diameter-contracted-portion 15, a tip-end-side trunk portion 17, a flange portion 19, a second-outer-diameter-contracted-portion 11, and a rear-end-side trunk portion 18 that are arranged from the front end side to the rear end side in this order.

The flange portion 19 is positioned at an approximately center of the insulator 10 in the axial direction. The outer diameter of the flange portion 19 is the largest among the outer diameter of the insulator 10. At the front end side of the flange portion 19, the tip-end-side trunk portion 17 is disposed. At the front end side of the tip-end-side trunk portion 17, the first-outer-diameter-contracted-portion 15 is disposed. The outer diameter of the first-outer-diameter-contracted-portion 15 gradually decreases from the rear end side to the front end side. At the front end side of the first-outer-diameter-contracted-portion 15, the nose portion 13 is disposed. If the spark plug 100 is installed to an internal combustion engine (not illustrated), the nose portion 13 is exposed in a combustion chamber.

At the rear end side of the flange portion 19, the second-outer-diameter-contracted-portion 11 is disposed. The outer diameter of the second-outer-diameter-contracted-portion 11 gradually decreases from the front end side to the rear end side. At the rear end side of the second-outer-diameter-contracted-portion 11, the rear-end-side trunk portion 18 is disposed.

Into the front end side of the through hole 12 of the insulator 10, the center electrode 20 is inserted. The center electrode 20 is a rod-shaped member extending along the central axis CL. The center electrode 20 includes an electrode base material 21 and a core material 22 buried inside of the electrode base material 21. The electrode base material 21 is, for example, formed using Inconel ("INCONEL" is a registered trademark), which is an alloy containing nickel as a main constituent. The core material 22 is, for example, formed with an alloy containing copper. A part of the rear end side of the center electrode 20 is disposed in the through hole 12 of the insulator 10. A part of the front end side of the center electrode 20 is exposed to the front end side of the insulator 10.

Into the rear end side of the through hole 12 of the insulator 10, the terminal metal fitting 40 is inserted. The terminal metal fitting 40 is a rod-shaped member extending along the central axis CL. The terminal metal fitting 40 is formed using a low-carbon steel (however, other conductive materials (for example, metallic materials) can also be employed). The terminal metal fitting 40 includes a flange portion 42, a plug cap installation portion 41, and a nose portion 43. The plug cap installation portion 41 is formed at the rear end side with respect to the flange portion 42. The nose portion 43 is formed at the front end side with respect to the flange portion 42. The plug cap installation portion 41 is exposed to the rear end side of the insulator 10. The nose portion 43 is inserted (press-fitted) into the through hole 12 of the insulator 10.

In the through hole 12 of the insulator 10, the resistor 70 is disposed between the terminal metal fitting 40 and the center electrode 20. The resistor 70 reduces radio wave noise during spark generation. The resistor 70 is, for example, formed of a composition containing glass particles such as $B_2O_3$—$SiO_2$-based glass particles, ceramic particles such as $TiO_2$, and a conductive material such as carbon particles and metal.

In the through hole 12, the conductive seal 60 fills space between the resistor 70 and the center electrode 20. The conductive seal 80 fills space between the resistor 70 and the terminal metal fitting 40. As a result, the center electrode 20 is electrically connected to the terminal metal fitting 40 via the resistor 70 and the conductive seals 60 and 80. The conductive seals 60 and 80 are, for example, formed with above-described various glass particles and metal particles (for example, Cu and Fe).

The metal shell 50 is a cylindrically-shaped metal shell to secure the spark plug 100 to an engine head (not illustrated) of the internal combustion engine. The metal shell 50 is formed using a low-carbon steel material (other conductive materials (for example, metallic materials) can also be employed). A through hole 59 is formed at the metal shell 50. The through hole 59 passes through the inside of the metal shell 50 and extends along the central axis CL. The insulator 10 is inserted into the through hole 59 of the metal shell 50. The metal shell 50 is secured to the outer circumference of the insulator 10. The front end of the insulator 10 (namely, the end at the +D1 side) is exposed from the front end of the metal shell 50. The rear end of the insulator 10 is exposed from the rear end of the metal shell 50.

The metal shell 50 includes a trunk portion 55, a seal portion 54, a deformed portion 58, a tool engagement portion 51, and a crimp portion 53 that are arranged from the front end side to the rear end side in this order. The seal portion 54 has an approximately cylindrical shape. At the front end side of the seal portion 54, the trunk portion 55 is disposed. The outer diameter of the trunk portion 55 is smaller than the outer diameter of the seal portion 54. At the outer peripheral surface of the trunk portion 55, a thread portion 52 is formed. The thread portion 52 is as to be screwed with a mounting hole of the internal combustion engine. Between the seal portion 54 and the thread portion 52, an annular-shaped gasket 5 is fitted by insertion. The annular-shaped gasket 5 is formed by folding a metal plate.

The trunk portion 55 of the metal shell 50 includes an inner-diameter-contracted-portion 56. The inner-diameter-contracted-portion 56 is disposed at the front end side with respect to the flange portion 19 of the insulator 10. The internal diameter of the inner-diameter-contracted-portion 56 gradually decreases from the rear end side to the front end side. The front end side packing 8 is sandwiched between the inner-diameter-contracted-portion 56 of the metal shell 50 and the first-outer-diameter-contracted-portion 15 of the insulator 10. The front end side packing 8 is an O-ring made of iron. As a material of the front end side packing 8, other materials (for example, a metallic material such as a copper) can also be employed.

At the rear end side of the seal portion 54, the deformed portion 58 is disposed. The wall thickness of the deformed portion 58 is thinner than the wall thickness of the seal portion 54. The deformed portion 58 has a deformed center portion protruding toward the outside of the radial direction (the direction away from the central axis CL). At the rear end side of the deformed portion 58, the tool engagement portion 51 is disposed. The tool engagement portion 51 has a shape with which a spark plug wrench is engaged (for example, a hexagonal prism). At the rear end side of the tool engagement portion 51, the crimp portion 53 with a wall thickness thinner than the wall thickness of the tool engagement portion 51 is disposed. The crimp portion 53 is disposed at the rear end side with respect to the second-outer-diameter-contracted-portion 11 of the insulator 10 and forms the rear end of the metal shell 50 (namely, the end at the −D1 side). The crimp portion 53 is flexed to radially inside.

An annular-shaped space SP is formed between the inner peripheral surface at the rear end side part of the metal shell 50 and the outer peripheral surface of the insulator 10. The space SP is surrounded by the inner peripheral surface of the metal shell 50 and the outer peripheral surface of the insulator 10, between the crimp portion 53 and the second-outer-diameter-contracted-portion 11. At the rear end side in the space SP, the first rear end side packing 6 is disposed. At the front end side in the space SP, the second rear end side packing 7 is disposed. In this embodiment, these rear end side packings 6 and 7 are C-rings made of iron (other materials can also be employed). A powder of talc 9 is filled between the two rear end side packings 6 and 7 in the space SP.

The crimp portion 53 is crimped so as to be folded to the inside. Accordingly, the insulator 10 in the metal shell 50 is pressed to the front end side via the rear end side packings 6 and 7 and the talc 9. Thus, the front end side packing 8 is pressed between the first-outer-diameter-contracted-portion 15 and the inner-diameter-contracted-portion 56. The front end side packing 8 seals between the metal shell 50 and the insulator 10. This reduces gas inside of the combustion chamber of the internal combustion engine to leak through between the metal shell 50 and the insulator 10.

The ground electrode 30 is a rod-shaped electrode sealed to the front end of the metal shell 50 (namely, the +D1 side end). The ground electrode 30 extends from the metal shell 50 in the D1 direction, bent to the central axis CL, and reaches a front end portion 31. The gap g is formed between the front end portion 31 and a front end surface 20*s*1 of the center electrode 20 (the surface 20*s*1 at the +D1 side). The ground electrode 30 is, for example, sealed to the metal shell 50 by laser beam welding. This electrically connects the ground electrode 30 and the metal shell 50. The ground electrode 30 includes a base material 35 and a core portion 36. The base material 35 forms the surface of the ground electrode 30. The core portion 36 is installed by being buried in the base material 35. The base material 35 is, for example, formed using Inconel. The core portion 36 is formed using a material whose thermal conductivity is higher than the base material 35 (for example, pure copper).

A2. Constitution of Electrodes

Figure 2A:
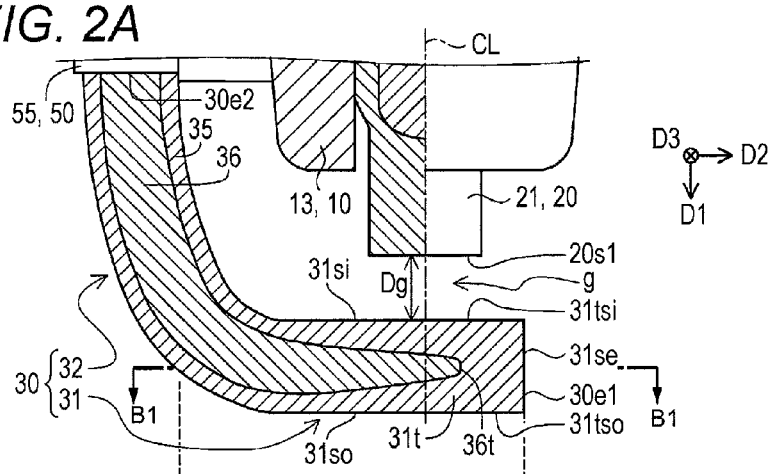
FIG. 2A to FIG. 2D are schematic diagrams illustrating a constitution of electrodes of the spark plug.
Figure 2B:
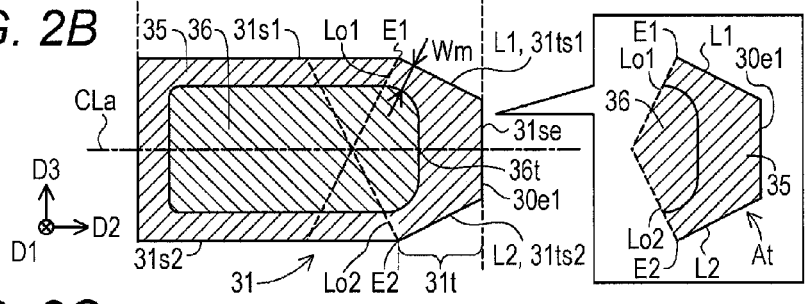
Figure 2C:
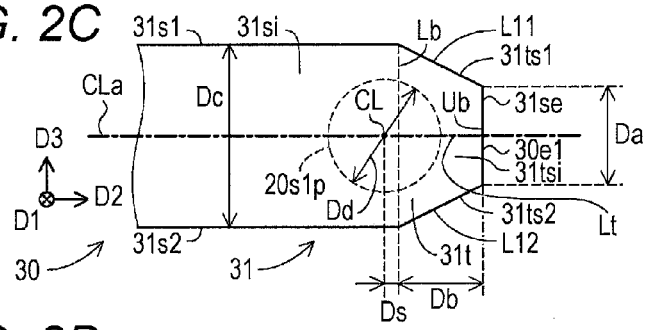
Figure 2D:
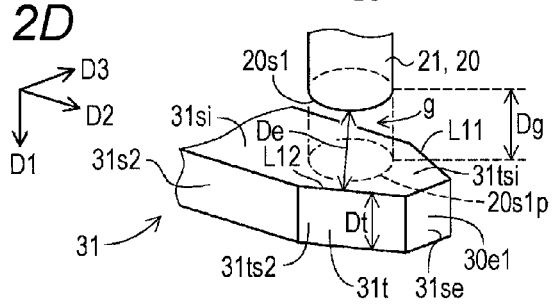

FIG. 2A to FIG. 2D are schematic diagrams illustrating a constitution of the electrodes 20 and 30 of the spark plug 100. FIG. 2A illustrates a sectional view of a part of the spark plug 100 at the first direction D1 side (specifically, the sectional view including the central axis CL). FIG. 2B illustrates the cross section of the ground electrode 30 (specifically, the cross section perpendicular to the central axis CL). FIG. 2C illustrates a schematic diagram of the ground electrode 30 viewed in the +D1 direction. FIG. 2D illustrates a perspective view of the electrodes 20 and 30. FIG. 2A illustrates external views of the center electrode 20 and the insulator 10 viewed facing the +D3 direction at the right side of the central axis CL. FIG. 2B is a cross section taken along the line B-B of FIG. 2A.

The ground electrode 30 is formed using a rod-shaped member with a rectangular cross section. As illustrated in FIG. 2A, the ground electrode 30 includes a nose portion 32 and the front end portion 31. The nose portion 32 includes a second end 30*e*2 sealed to the metal shell 50. The front end portion 31 is connected to the nose portion 32. The front end portion 31 includes a first end 30*e*1 disposed opposite side to the second end 30*e*2. The nose portion 32 extends from the second end 30*e*2 to the first direction D1 side and then is bent to the central axis CL. The direction from the second end 30*e*2 to the central axis CL is the second direction D2. The front end portion 31 is positioned at the +D1 side with respect to the center electrode 20. The front end portion 31 extends from the −D2 side to the +D2 side based on the central axis CL. The end portion of the front end portion 31 at the +D2 side is the first end 30*e*1. The front end portion 31 includes the first end 30*e*1 and an inner surface 31*si*. The inner surface 31*si* is a part facing the front end surface 20*s*1 (namely, the surface 20*s*1 at the +D1 side) of the center electrode 20.

As illustrated in FIG. 2A, the ground electrode 30 includes the base material 35 and the core portion 36. The base material 35 forms the surface of the ground electrode 30. The core portion 36 is installed by being buried in the base material 35. The core portion 36 extends from the second end 30*e*2 to the middle of the front end portion 31. Here, among both ends of the core portion 36, an end 36*t* closer to the front end portion 31 of the ground electrode 30 is referred to as a "front end 36*t*." FIG. 2B illustrates the cross section of the ground electrode 30 that includes the front end 36*t* of the core portion 36 and is perpendicular to the central axis CL. FIG. 2B is a sectional view taken along the line B-B of FIG. 2A.

As illustrated in FIG. 2A to FIG. 2D, the front end portion 31 includes the inner surface 31*si*, an outer surface 31*so*, a first side surface 31*s*1, and a second side surface 31*s*2. The inner surface 31*si* is a surface at the −D1 side of the front end portion 31. The outer surface 31*so* is a surface at the +D1 side of the front end portion 31. The first side surface 31*s*1 is a surface at the +D3 side of the front end portion 31. The second side surface 31*s*2 is a surface at the −D3 side of the front end portion 31. Both the inner surface 31*si* and the outer surface 31*so* are planes perpendicular to the central axis CL. Both of the two side surfaces 31*s*1 and 31*s*2 are planes vertical to the D3 direction. The inner surface 31*si* faces the front end surface 20*s*1 of the center electrode 20. The front end surface 20*s*1 is a plane perpendicular to the central axis CL. Between the inner surface 31*si* and the front end surface 20*s*1, the spark gap g is formed. A distance Dg in FIG. 2A indicates a distance of the spark gap g (hereinafter also referred to as the "gap distance Dg"). The gap distance Dg is the shortest distance between the two surfaces 20*s*1 and 31*si*, which form the gap g.

As illustrated in FIG. 2A to FIG. 2D, the front end portion 31 includes a tapered end portion 31*t*. The tapered end portion 31*t* has a tapered shape gradually thinned toward the first end 30*e*1. The tapered end portion 31*t* includes an opposed surface 31*tsi*, an outer surface 31*tso*, a first tapered surface 31*ts*1, a second tapered surface 31*ts*2, and a front end surface 31*se*. The opposed surface 31*tsi* is a surface at the −D1 side of the tapered end portion 31*t*. The outer surface 31*tso* is a surface of the +D1 side of the tapered end portion 31*t*. The first tapered surface 31*ts*1 is a surface at the +D3 side of the tapered end portion 31*t*. The second tapered surface 31*ts*2 is a surface at the −D3 side of the tapered end portion 31*t*. The front end surface 31*se* is a surface at the +D2 side of the tapered end portion 31*t*. The opposed surface 31*tsi* is a part of the inner surface 31*si* of the front end portion 31 and faces the front end surface 20*s*1 of the center electrode 20. Between the opposed surface 31*tsi* and the front end surface 20*s*1, the gap g is formed. The outer surface 31*tso* is a part of the outer surface 31*so* of the ground electrode 30. The front end surface 31*se* corresponds to the first end 30*e*1 of the ground electrode 30. The first tapered surface 31*ts*1 connects the first side surface 31*s*1 and the front end surface 31*se*. The second tapered surface 31*ts*2 connects the second side surface 31*s*2 and the front end surface 31*se*.

As illustrated in FIG. 2C, the opposed surface 31*tsi* has a trapezoidal shape whose width gradually narrows toward the +D2 direction. The outer surface 31*tso* (not illustrated) also has a trapezoidal shape same as the opposed surface 31*tsi*. Hereinafter, among two parallel sides Ub and Lb of the trapezoid representing the opposed surface 31*tsi*, the comparatively short side Ub is referred to as the "upper bottom Ub", and the comparatively long side Lb is referred to as the "lower bottom Lb." The upper bottom Ub is an edge line forming a boundary between the opposed surface 31*tsi* and the front end surface 31*se*. A pair of tapered surfaces 31*ts*1 and 31*ts*2 are disposed so as to sandwich the opposed surface 31*tsi*. A distance among the two tapered surfaces 31*ts*1 and 31*ts*2 (a distance parallel to the third direction D3) gradually decreases toward the +D2 direction.

FIG. 2C illustrates a symmetric surface CLa. The symmetric surface CLa is a plane that includes the central axis CL and is parallel to the second direction D2. The ground electrode 30 is constituted so as to be symmetry with respect to the symmetric surface CLa. The cross section of the ground electrode 30 illustrated in FIG. 2A is a cross section on the symmetric surface CLa. As illustrated in FIG. 2C, a line Lt extends on the opposed surface 31*tsi* of the tapered end portion 31*t* along the longitudinal direction of the ground electrode 30 (here, in the second direction D2). The line Lt almost uniformly divides the opposed surface 31*tsi* by two. The cross section on the symmetric surface CLa includes this line Lt and is perpendicular to the opposed surface 31*tsi*. Hereinafter, the cross section uniformly dividing the opposed surface 31*tsi* by two like this is also referred to as a "halving cross section."

FIG. 2B illustrates a first line segment L1 corresponding to the first tapered surface 31*ts*1 and a second line segment L2 corresponding to the second tapered surface 31*ts*2. In the drawing, a first rear end E1 is an end farther from the front end surface 31*se* among both ends of the first line segment L1, and a second rear end E2 is an end farther from the front end surface 31*se* among both ends of a second line segment L2. A first vertical line Lo1 is a straight line that passes the first rear end E1 and is vertical to the first line segment L1. A second vertical line Lo2 is a straight line that passes the second rear end E2 and is vertical to the second line segment L2. FIG. 2B illustrates a part of a region At cut out from the drawing in FIG. 2B at the right side. This region At is at the front end side with respect to the first vertical line Lo1 (the first end 30*e*1 side of the ground electrode 30) and a region at the front end side with respect to the second vertical line Lo2. A part of the core portion 36 is disposed in the region At in the cross section of FIG. 2B. Thus, the part of the core portion 36 is disposed in the region At. In view of this, compared with the case where the core portion 36 is not disposed in the region At, during an operation of the internal combustion engine, heat can be easily released from the front end portion 31 to another portion of the ground electrode 30 (here, the nose portion 32) with the core portion 36. Therefore, high temperature of the front end portion 31 and a state where the temperature of the front end portion 31 remains high can be suppressed. This allows suppressing wear of the front end portion 31 (for example, oxidation of the surface of the front end portion 31).

FIG. 2C and FIG. 2D illustrate a region 20*s*1*p* by dashed line. The region 20*s*1*p* is a region obtained by projecting the front end surface 20*s*1 of the center electrode 20 on the ground electrode 30 along the central axis CL (to the +D1 direction) (hereinafter also referred to as the "projection region 20*s*1*p*"). As illustrated in FIG. 2C, the projection region 20*s*1*p* (namely, the front end surface 20*s*1) has a circular shape. The tapered end portion 31*t* partially overlaps this projection region 20*s*1*p*. In the example of FIG. 2C, the lower bottom Lb of the opposed surface 31*tsi* is disposed at the +D2 side with respect to the central axis CL. However, the lower bottom Lb may be disposed at the −D2 side with respect to the central axis CL.

FIG. 2C and FIG. 2D illustrate two edge lines L11 and L12. The first edge line L11 forms a boundary between the opposed surface 31*tsi* and the first tapered surface 31*ts*1. The second edge line L12 forms a boundary between the opposed surface 31*tsi* and the second tapered surface 31*ts*2. As illustrated in the drawing, both the edge lines L11 and L12 do not overlap the projection region 20*s*1*p* and are away from the projection region 20*s*1*p*. A distance De illustrated in FIG. 2D is the shortest distance between the front end surface 20*s*1 of the center electrode 20 and the second edge line L12 (hereinafter also referred to as the "edge distance De"). In this embodiment, a length of a line segment connecting the edge of the front end surface 20*s*1 and the second edge line L12 corresponds to the edge distance De. This edge distance De is longer than the gap distance Dg. Generally, discharge is likely to occur at a pointed part among the surface of the electrode.

That is, discharge is likely to occur at the pointed part like the second edge line L12 rather than a flat surface like the projection region 20*s*1*p*. Therefore, even if the edge distance De is longer than the gap distance Dg, discharge can occur between the front end surface 20*s*1 and the second edge line L12. As described above, the ground electrode 30 is constituted so as to be symmetry with respect to the symmetric surface CLa. In view of this, the shortest distance between the front end surface 20*s*1 and the first edge line L11 is also the same as the edge distance De. Therefore, discharge can occur between the front end surface 20*s*1 and the first edge line L11.

If discharge occurs at the inside of the inner surface 31*si* of the ground electrode 30 (for example, the inside of the projection region 20*s*1*p*), a flame occurred by the discharge spreads to the end of the inner surface 31*si* and then spreads to the outside of the gap g. On the other hand, if discharge occurs at the edge line L11 and/or L12, a flame occurred by the discharge can spread to the outside of the gap g immediately. Therefore, if discharge occurs at the e edge line L11 and/or L12, compared with the case where discharge occurs at the inside of the inner surface 31*si*, ignitability can be further improved.

A3. First Evaluation Test

The following describes the first evaluation test using samples of the spark plugs 100. The first evaluation test used six pieces of the spark plugs 100 as the samples. The spark plugs 100 differed in a ratio of the edge distance De to the gap distance Dg (FIG. 2A), "De/Dg", (hereinafter referred to as a "gap ratio") from one another. Then, a ratio of the number of times of discharges occurred between the center electrode 20 and the edge line (the first edge line L11 or the second edge line L12) to the total number of times of discharges occurred at the spark plug 100 (here, 1000 times) (hereinafter referred to as an "edge discharge ratio") was measured. All the samples used Inconel as the material of the base material 35 and a pure copper as the material of the core portion 36. The following Table 1 is measurement results of the first evaluation test.

TABLE 1

| De/Dg | 100% | 110% | 120% | 125% | 130% | 135% |
|---|---|---|---|---|---|---|
| Discharge ratio at edge | 99% | 95% | 85% | 60% | 40% | 20% |

Dimensions common to six pieces of the samples employed for the evaluation test were as follows.

1) Width Da of the first end 30*e*1 of the tapered end portion 31*t* in the third direction D3: 1.5 mm This width Da was the same length as the length of the upper bottom Ub of the opposed surface 31*tsi*.

2) Length Db of the tapered end portion 31*t* in the D2 direction: 1.6 mm

3) Width Dc of the front end portion 31 (excluding the tapered end portion 31*t*) in the third direction D3: 3.0 mm This width Dc was the same length as the length of the lower bottom Lb of the opposed surface 31*tsi*.

4) Thickness Dt of the front end portion 31 in the D1 direction: 1.6 mm

5) Diameter Dd of the front end surface 20*s*1 of the center electrode 20: 1.5 mm 6) Gap distance Dg: 1.0 mm The edge distances De of six pieces of the samples differed from one another. The edge distance De was adjusted by adjusting the distance Ds between the lower bottom Lb and the central axis CL of the front end surface 20*s*1 in the second direction D2, and a condition of bending of the nose portion 32 of the ground electrode 30.

The testing method was as follows. The spark plug 100 was disposed in a container for experiment filled with air. The internal pressure of the container was raised to 0.6 MPa. This pressure was determined assuming pressure in the combustion chamber of the internal combustion engine at ignition. With this state, a voltage was applied to the spark plug 100, thus discharge was conducted. The discharging state was taken with a high-speed camera to confirm whether the discharge occurred at the edge line L11 and/or L12; or the inside of the inner surface 31*si* on the ground electrode 30. After 1000 times discharges at 100 Hz, the edge discharge ratio was calculated.

As listed in Table 1, the smaller the gap ratio, the higher the edge discharge ratio. This is probably due to the following reason. That is, compared with the case where the gap ratio is large, the edge distance De with respect to the gap distance Dg is short in case the gap ratio is small. In view of this, discharge is likely to occur at the edge lines L11 and L12. Specifically, as listed in Table 1, when the gap ratio was 100% (if the edge line(s) L11 and/or L12 overlaps the projection region 20*s*1*p*), the edge discharge ratio was 99%. When the gap ratios was 110%, 120%, 125%, 130%, and 135%, the respective edge discharge ratios were 95%, 85%, 60%, 40%, and 20%.

As described above, if discharge occurs at the edge line(s) L11 and/or L12, ignitability can be improved. Therefore, from the aspect of improvement in ignitability, a small gap ratio is preferable. For example, the use of the gap ratio of 120% or less allows achieving the edge discharge ratio of 85% or more. Thus, the gap ratio of 120% or less is preferable, and the gap ratio of 110% or less is particularly preferable, and the gap ratio of 100% is the most preferable. The lower limit of the gap ratio is 100%.

The likelihood of discharge at the edge line(s) L11 and/or L12 is assumed to change mainly according to the ratio of the edge distance De to the gap distance Dg. Therefore, the above-described preferable upper limits of the gap ratio are presumably applicable regardless of the constitution other than the gap ratio. For example, the preferable upper limits are presumably applicable regardless of a material of a part forming the front end surface 20*s*1 among the center electrode 20, the area of the front end surface 20*s*1, and/or a material of a part forming the inner surface 31*si* among the ground electrode 30.

A4. Second Evaluation Test

The following describes the second evaluation test using samples of the spark plugs 100. The second evaluation test measured an amount of gap distance Dg increase after operating the internal combustion engine with the spark plug 100 for 100 hours. The second evaluation test used an internal combustion engine with inline-four engines, a Single Over-Head camshaft (SOHC), two valves, and a displacement of 1.3 L. The 100-hour operation repeated an operation of one cycle including one-minute idling operation and one-minute wide open throttle (also referred to as WOT) operation 3000 times. The maximum temperature at the part close to the gap g among the ground electrode 30 was approximately 300 degrees Celsius during the idling operation, and approximately 1000 degrees Celsius during the wide open throttle operation.

In the second evaluation test, ten pieces of the spark plugs 100 were prepared as the samples. The positions of the core portions 36 with respect to the tapered surfaces 31*ts*1 and 31*ts*2 of ten pieces of the samples differed from one another.

The cross section of FIG. 2B illustrates a shortest distance Wm between the first line segment L1 corresponding to the first tapered surface 31*ts*1 and the core portion 36. The shortest distances Wm of ten pieces of the samples differed from one another. The shortest distance Wm was adjusted as follows. First, a cup-shaped first member made of Inconel was prepared. Into the first member, a second member made of pure copper was inserted. Then, with the second member inserted, an outer shape of the first member was molded, to manufacture the ground electrode 30. The first member corresponded to the base material 35, and the second member corresponded to the core portion 36. Here, by adjustment of the thickness of the cup-shaped first member before molding, the shortest distance Wm was adjusted. In this embodiment, the shortest distance Wm was shorter than the shortest distance between the core portion 36 and the front end surface 31*se* (that is, a distance between the front end 36*t* and the front end surface 31*se*). As described above, the ground electrode 30 was symmetry with respect to the symmetric surface CLa. In view of this, the shortest distance between the second line segment L2 corresponding to the second tapered surface 31*ts*2 and the core portion 36 was also the same length as the length of the shortest distance Wm. The ground electrodes 30 of ten pieces the samples had the approximately same outer shape. The following Table 2 indicates the measurement results in the second evaluation test.

TABLE 2

| Wm | 0.1 | 0.2 | 0.3 | 0.5 | 0.7 | 0.9 | 1.1 | 1.3 | 1.5 | 1.7 |
|---|---|---|---|---|---|---|---|---|---|---|
| dDg | — | 0.13 | 0.12 | 0.13 | 0.14 | 0.16 | 0.18 | 0.21 | 0.25 | 0.34 |
| Evaluation | C | A | A | A | A | A | A | A | A | B |

A unit of the shortest distance Wm is a millimeter. An increased amount dDg of the gap distance Dg (hereinafter referred to as an "amount of gap increase dDg") is a difference (unit is millimeter) subtracting the gap distance Dg before the operation from the gap distance Dg after the 100-hour operation. The evaluation result indicates that Evaluation A suggests that the amount of gap increase dDg is less than 0.3 mm. Evaluation B suggests that the amount of gap increase dDg is 0.3 mm or more. Evaluation C suggests that the base material 35 of the ground electrode 30 was bursted by the 100-hour operation. That is, the core portion 36 protruded out of the base material 35.

Ten pieces of the samples employed for the second evaluation test had the same length Da, Db, Dc, Dt, Dd, Ds, and Dg before the tests (namely, before the 100-hour operation), as the respective length of the samples employed for the first evaluation test. The edge distance De before the test was 1.2 mm. The material of the base material 35 was Inconel, and the material of the core portion 36 was pure copper.

As listed in Table 2, the amount of gap increase dDg tends to decrease as the decreasing shortest distance Wm. This is probably due to the following reason. That is, the smaller the shortest distance Wm, the larger the proportion of the core portion 36 to the inside of the front end portion 31 of the ground electrode 30. In view of this, during the operation of the internal combustion engine, heat can be easily released from the front end portion 31 to another portion of the ground electrode 30 (here, the nose portion 32). Therefore, high temperature of the front end portion 31 and a state where the temperature of the front end portion 31 remains high can be suppressed. This allows suppressing wear of the front end portion 31 (for example, oxidation of the surface of the front end portion 31). This allows suppressing an increase of the amount of gap increase dDg.

Specifically, as listed in Table 2, when the shortest distance Wm was 0.1 mm, the ground electrode 30 bursted during the test. When the shortest distances Wm were 0.2 mm, 0.3 mm, 0.5 mm, 0.7 mm, 0.9 mm, 1.1 mm, 1.3 mm, 1.5 mm, and 1.7 mm, the respective amount of gap increase dDg were 0.13 mm, 0.12 mm, 0.13 mm, 0.14 mm, 0.16 mm, 0.18 mm, 0.21 mm, 0.25 mm, and 0.34 mm. Thus, when the shortest distance Wm was 0.2 mm or more and 1.5 mm or less, the evaluation result was Evaluation A. When the shortest distance Wm was 1.7 mm, the evaluation result was Evaluation B.

Thus, setting the shortest distance Wm 1.5 mm or less allows suppressing the amount of gap increase dDg to less than 0.3 mm. Setting the shortest distance Wm to 0.2 mm or more allows suppressing damage (for example, burst) in the ground electrode 30. Accordingly, to improve durability of the ground electrode 30, setting the shortest distance Wm to 0.2 mm or more and 1.5 mm or less is preferable. The shortest distances Wm where good evaluation results were obtained were 0.2 mm, 0.3 mm, 0.5 mm, 0.7 mm, 0.9 mm, 1.1 mm, 1.3 mm, and 1.5 mm. Any value among these values can be employed as a preferable upper limit of a range of the shortest distance Wm. Any value among these values equal to or less than the upper limit can be employed as a preferable lower limit of the range of the shortest distance Wm.

An effect of cooling the surface of the front end portion 31 (in particular, the tapered surfaces 31*ts*1 and 31*ts*2) with the core portion 36 is presumably changed mainly according to the shortest distance Wm. Therefore, the preferable range of the shortest distance Wm is presumably applicable regardless of the constitution other than the shortest distance Wm. For example, the preferable range is applicable regardless of the shape of the ground electrode 30.

A5. Third Evaluation Test

The following describes the third evaluation test using samples of the spark plugs 100. The third evaluation test evaluated durability of the ground electrode 30. This test employed five pieces of the spark plugs 100 with the core portions 36 whose materials differed from one another as the samples. The following Table 3 lists the evaluation results of the third evaluation test.

TABLE 3

| Material | Melting point (C. °) | Evaluation |
|---|---|---|
| Cu | 1083 | B |
| SUS304 | 1350 | A |
| High Ni alloy | 1413 | A |
| Ni | 1453 | A |
| Fe | 1536 | A |

Five pieces of the samples employed for the third evaluation test had the same length Da, Db, Dc, Dt, Dd, Ds, and Dg before the test, as the respective values of the samples employed for the first evaluation test. The material of the base material 35 was Inconel. Before the test, the edge distance De was 1.2 mm, and the shortest distance Wm was 0.2 mm.

The third evaluation test repeated a cycle of heating and cooling on the electrodes 20 and 30 of the spark plug 100 by 3000 times. A change in the ground electrode 30 by this was evaluated. Specifically, the one cycle includes heating the electrodes 20 and 30 (in particular, near the gap g) for one minute with burner and subsequently cooling the electrodes 20 and 30 for one minute in the air. The one-minute heating increases the temperature at the part close to the gap g among the ground electrode 30 to 1100 degrees Celsius. This temperature is higher than the temperature in the above-described second evaluation test (approximately 1000 degrees Celsius). That is, the third evaluation test conducted the evaluation under the severe condition compared with the second evaluation test.

Table 3 lists materials of the core portions 36, melting points of the materials, and evaluation results of the third evaluation test. As the materials of the core portion 36, a pure copper (Cu), a stainless steel (SUS304), a high nickel alloy, a pure nickel (Ni), and a pure iron (Fe) were employed. Evaluation A suggests that no change was seen in the ground electrode 30. Evaluation B suggests that the ground electrode 30 was bursted. As listed in Table 3, the evaluation result of when the material of the core portion 36 was a pure copper was Evaluation B. This is presumably because the base material 35 was damaged due to thermal expansion of the core portion 36 inside of the base material 35 and a leakage of the core portion 36 melted during heating from the damaged base material 35. When the material of the core portion 36 was any of a stainless steel (SUS304), a high nickel alloy, a pure nickel, and a pure iron, the evaluation result was Evaluation A. This is presumably that the melting point of the material of the core portion 36 was higher than the temperature of the ground electrode 30 during heating (approximately 1100 degrees Celsius); therefore, the core portion 36 failed to melt.

As described above, employing the material with higher melting point than the temperature of the ground electrode 30 during heating as the material of the core portion 36 allows suppressing burst of the ground electrode 30. The maximum temperature of the ground electrode 30 during operation of the internal combustion engine differs depending on the internal combustion engine. Internal combustion engines widely prevalent generally are designed assuming that the maximum temperature of the ground electrode 30 is less than 1000 degrees Celsius. When using such internal combustion engine, employing various materials with higher melting point than the assumed maximum temperature (here, 1000 degrees Celsius) (for example, various metallic materials containing a pure copper) as the material of the core portion 36 is possible. The internal combustion engine designed assuming the excess of the maximum temperature of the ground electrode 30 over 1000 degrees Celsius is also possibly used. For example, in such internal combustion engines, the assumed maximum temperature of the ground electrode 30 can be 1100 degrees Celsius. In this case, various materials with higher melting point than the assumed maximum temperature can be employed as the material of the core portion 36. Generally, as evaluated in the evaluation test listed in Table 3, employing the material with the melting point of 1350 degrees Celsius or more to the ground electrode 30 allows providing the spark plug 100 applicable to various internal combustion engines.

The third evaluation test was evaluated under the condition of the maximum temperature of the ground electrode 30 being 1100 degrees Celsius. The melting points of the materials where good evaluation result was obtained in the third evaluation test were 1350 degrees Celsius, 1413 degrees Celsius, 1453 degrees Celsius, and 1536 degrees Celsius. Any value among these values can be employed as a preferable lower limit of a range of the melting point. Any value among these values equal to or more than the lower limit can be employed as a preferable upper limit of the range of the melting point.

B. Second Embodiment

B1. Constitution of Spark Plug

Figure 3A:
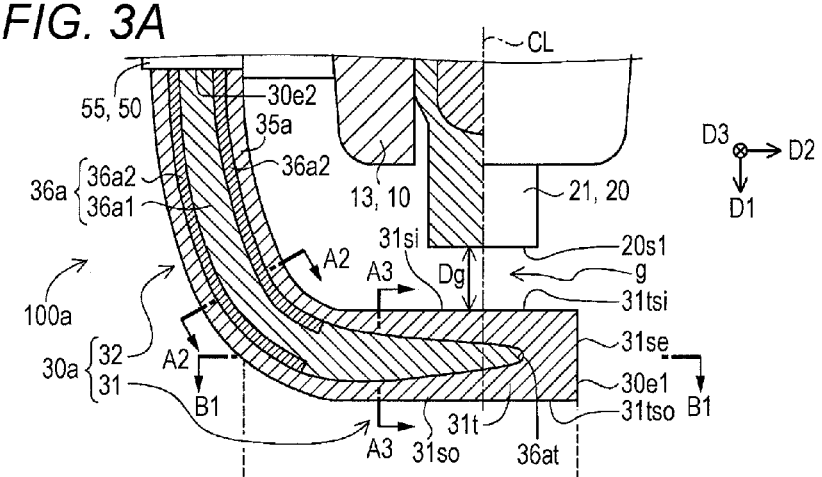
FIG. 3A to FIG. 3E are schematic diagrams illustrating a constitution of electrodes of the spark plug of a second embodiment.
Figure 3B:
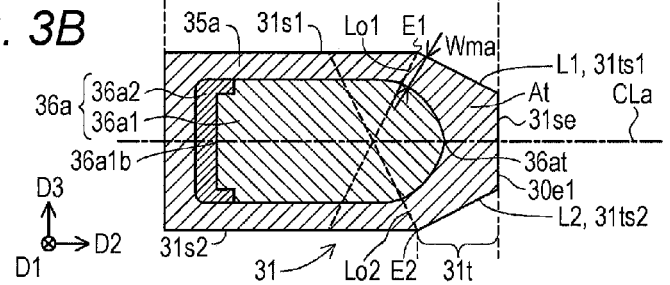
Figure 3C:
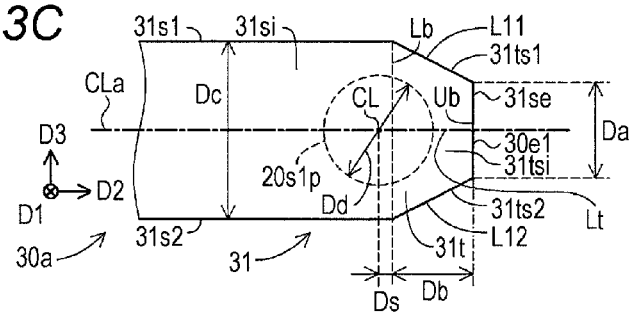
Figure 3D:
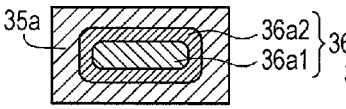
Figure 3E:
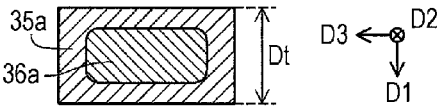

FIG. 3A to FIG. 3E are schematic diagrams illustrating a constitution of electrodes 20 and 30*a* of a spark plug 100*a* of a second embodiment. FIG. 3A to FIG. 3C are schematic diagrams similar to the respective FIG. 2A to FIG. 2C. FIG. 3D illustrates a cross section taken along the line A2-A2 of FIG. 3A. FIG. 3E illustrates a cross section taken along the line A3-A3 of FIG. 3A. The main difference between the spark plug 100 of the first embodiment, which is illustrated in FIG. 2A to FIG. 2D, and the spark plug 100*a* of the second embodiment, which is illustrated in FIG. 3A to FIG. 3D, is the core portion of the ground electrode. That is, in the spark plug 100*a* of the second embodiment, the core portion 36 of the spark plug 100 of the first embodiment is replaced by a core portion 36*a* that includes a first core portion 36*a*1 and a second core portion 36*a*2. The constitution excluding the ground electrode 30*a* is the same as the constitution of the first embodiment described in FIG. 1 and FIG. 2A to FIG. 2D. The ground electrode 30*a* is constituted so as to be symmetry with respect to the symmetric surface CLa. Among components of the spark plug 100*a* of the second embodiment, such elements that reference numerals designate identical elements to those of the spark plug 100 of the first embodiment will not be further elaborated.

As illustrated in FIG. 3A, the ground electrode 30*a* includes a base material 35*a* and the core portion 36*a* buried in the base material 35*a*. The shape of the ground electrode 30*a* (namely, the outer shape of the base material 35*a*) is the same as the shape of the ground electrode 30 of the first embodiment (namely, the outer shape of the base material 35).

The core portion 36*a* includes the first core portion 36*a*1 and the second core portion 36*a*2. The second core portion 36*a*2 is disposed between the base material 35 and the first core portion 36*a*1. The first core portion 36*a*1 extends from the second end 30*e*2 of the ground electrode 30*a* to a front end 36 at disposed in the middle of the front end portion 31, similar to the core portion 36 of the first embodiment. The second core portion 36*a*2 is a tube-shaped layer covering the rear end side of the first core portion 36*a*1 (namely, the second end 30*e*2 side). The second core portion 36*a*2 extends from the second end 30*e*2 of the ground electrode 30*a* to the near position with respect to the front end 36 at of the first core portion 36*a*1. The front end side of the first core portion 36*a*1 (that is, the first end 30*e*1 side) part, is not covered with the second core portion 36*a*2 but contacts the base material 35*a*. The front end 36 at of the first core portion 36*a*1 forms the end 36*at* at a part closer to the front end portion 31 of the ground electrode 30*a* among both ends of the core portion 36*a*. A part of the first core portion 36*a*1 covered with the second core portion 36*a*2 is thinner than the part not covered with the second core portion 36*a*2. Accordingly, thickness of the part including the second core portion 36*a*2 among the core portion 36*a* is reduced to be excessively thick. The thickness of the core portion 36*a* smoothly changes from the second end 30*e*2 to the front end 36*at*.

The first core portion 36*a*1 is formed of a material of higher thermal conductivity than the base material 35*a*. The second core portion 36*a*2 is formed of a material of higher thermal conductivity than the first core portion 36*a*1. For example, the material of the base material 35*a* is Inconel, the material of the first core portion 36*a*1 is a pure nickel, and the material of the second core portion 36*a*2 is a pure copper. Here, as a material of a part including the front end 36 at among the core portion

36*a* (here, the first core portion 36*a*1), employing a material with melting point of 1350 degrees Celsius or more is preferable. For example, any material selected from the stainless steel (SUS304), high nickel alloy, the pure nickel, and the pure iron listed in Table 3 may be employed.

FIG. 3D illustrates a cross section of a part including the second core portion 36*a*2 among the ground electrode 30*a* (namely, the rear end side part of the ground electrode 30*a*, here, the nose portion 32). This cross section is vertical to the direction that the ground electrode 30*a* extends. On the cross section, the second core portion 36*a*2 covers the whole circumference of the first core portion 36*a*1. The cross-sectional structure is three-layered structure of the first core portion 36*a*1, the second core portion 36*a*2, and the base material 35*a*.

FIG. 3E illustrates a cross section of a part that includes the first core portion 36*a*1 but does not include the second core portion 36*a*2 (namely, a part at the front end side of the ground electrode 30*a*, here, the front end portion 31) among the ground electrode 30*a*. This cross section is vertical to the direction that the ground electrode 30*a* extends, that is, a cross section vertical to the second direction D2. The cross-sectional structure is two-layered structure of the first core portion 36*a*1 and the base material 35*a*.

FIG. 3B illustrates a cross section that includes the front end 36 at of the core portion 36*a* and is perpendicular to the central axis CL. A shortest distance Wma in the drawing is the shortest distance between the first line segment L1 and the core portion 36*a* (here, the first core portion 36*a*1). In this embodiment, the shortest distance Wma is shorter than the shortest distance between the core portion 36 and the front end surface 31*se* of the ground electrode 30*a* (that is, a distance between the front end 36 at of the core portion 36*a* and the front end surface 31*se*). As illustrated in FIG. 3E, the cross section at the front end side of the ground electrode 30*a* (namely, the first end 30*e*1 side), includes two layers of the first core portion 36*a*1 and the base material 35*a*. Here, as the cross-sectional structure of the front end side of the ground electrode 30*a*, the cross-sectional structure of the front end side (the first end 30*e*1 side) from a part including the front end 36 at among the contour of the cross section of the first core portion 36*a*1 in the cross section in FIG. 3B can be employed. As illustrated in FIG. 3D, the cross section of the rear end side of the ground electrode 30*a* (namely, the second end 30*e*2 side) includes three layers of the first core portion 36*a*1, the second core portion 36*a*2, and the base material 35*a*. Here, as the cross-sectional structure of the rear end side of the ground electrode 30*a*, the cross-sectional structure of the rear end side from a part including a rear end 36*a*1*b* (the end 36*a*1*b*, which is farthest from the first end 30*e*1 of the ground electrode 30*a*) among the contour of the cross section of the first core portion 36*a*1 in the cross section in FIG. 3B can be employed.

B2. Fourth Evaluation Test

The following describes the fourth evaluation test using samples of the spark plugs 100*a* of the second embodiment. The fourth evaluation test measured the amount of gap distance Dg increase after operating the internal combustion engine with the spark plug 100*a* for 100 hours, similarly to the above-described second evaluation test. The difference of the fourth evaluation test from the second evaluation test is that an operation in the internal combustion engine was adjusted such that the maximum temperature at a part close to the gap g in the ground electrode 30 became 1100 degrees Celsius, which is higher than 1000 degrees Celsius, during wide open throttle operation. Thus, the fourth evaluation test conducted the evaluation under the severe condition compared with the second evaluation test.

In the fourth evaluation test, two pieces of the spark plugs 100*a* with the second core portions 36*a*2 whose lengths differed from one another were prepared as samples (a first sample and a second sample). The constitution of the first sample was the same as the constitution described in FIG. 3A to FIG. 3D. Meanwhile, the constitution of the second sample (not illustrated) differed from the first sample in the following points. That is, the second core portion 36*a*2 of the second sample extended from the second end 30*e*2 to a position at the cross section taken along the line A2-A2, which is a midpoint of the nose portion 32. On the other hand, the second core portion 36*a*2 is not disposed at the front end side with respect to the position at the cross section taken along the line A2-A2. That is, the second sample did not include the second core portion 36*a*2 at the cross section corresponding to FIG. 3B. Two pieces of the samples had the same length Da, Db, Dc, Dt, Dd, De, Ds, and Dg as the respective length of the samples employed for the second evaluation test before the test (namely, before the 100-hour operation). The shortest distance Wma (see FIG. 3B) of the two samples was 1.3 mm. In the two samples, the materials of the base materials 35*a* were Inconel, the materials of the first core portions 36*a*1 were a pure nickel, and the materials of the second core portions 36*a*2 were a pure copper.

Measurements of respective amount of gap distance Dg increase of the two pieces of samples obtained the following results.

1) First sample: 0.27 mm

2) Second sample: 0.33 mm

As described above, the case where the cross section of FIG. 3B included the second core portion 36*a*2 (the first sample) succeeded to reduce an amount of gap distance Dg increase compared with the case where the cross section did not include the second core portion 36*a*2 (the second sample). Accordingly, it is inferred that in the case where the cross section including the front end 36 at of the core portion 36*a* includes at least a part of the second core portion 36*a*2, compared with the case where the cross section does not include the second core portion 36*a*2, high temperature of the front end portion 31 can be suppressed.

In the cross section illustrated in FIG. 3B, the cross-sectional structure of the front end side of the ground electrode 30*a* (namely, the first end 30*e*1 side) includes two layers of the first core portion 36*a*1 and the base material 35*a*. Thus, in FIG. 3B, the second core portion 36*a*2 is not disposed at the front end side of the core portion 36*a* (that is, a part where a temperature becomes high). As the result, melting of the second core portion 36*a*2 and causing the second core portion 36*a*2 to run out of (burst) the base material 35*a* can be suppressed.

In the case where a part of the second core portion 36*a*2 is disposed at the cross section illustrated in FIG. 3B, regardless of the respective shapes of the first core portion 36*a*1, the second core portion 36*a*2, and the base material 35*a*, heat can be easily released from the front end portion 31 to another portion of the ground electrode 30*a* (here, for example, the nose portion 32) with the second core portion 36*a*2. In the case where the second core portion 36*a*2 is disposed not at the front end side but the rear end side at the cross section illustrated in FIG. 3B, regardless of the respective shapes of the first core portion 36*a*1, the second core portion 36*a*2, and the base material 35*a*, melting of the second core portion 36*a*2 and causing the second core portion 36*a*2 to run out of (burst) the base material 35*a* can be suppressed.

C. Third Embodiment

C1. Constitution of Spark Plug

Figure 4A:
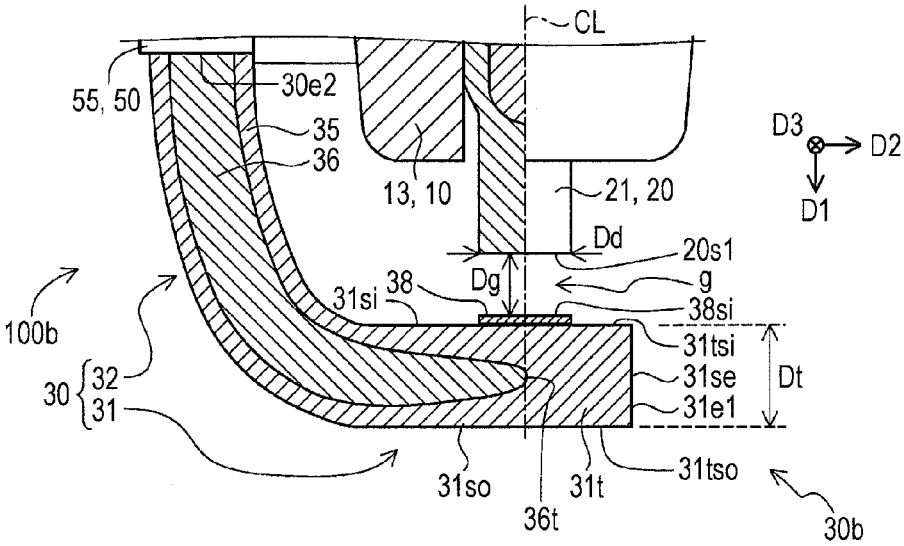
FIG. 4A and FIG. 4B are schematic diagrams illustrating a constitution of electrodes of a spark plug of a third embodiment.
Figure 4B:
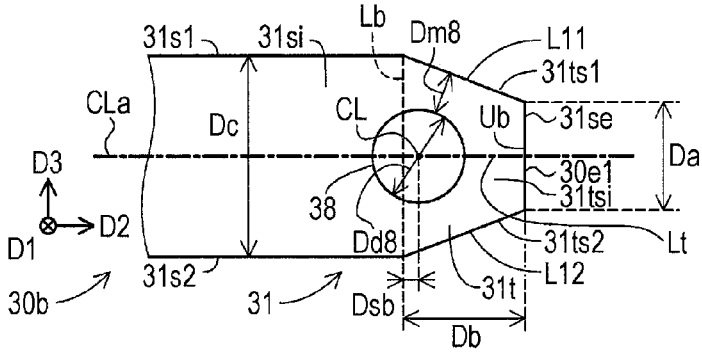

FIG. 4A and FIG. 4B are schematic diagrams illustrating a constitution of electrodes 20 and 30*b* of a spark plug 100*b* of a third embodiment. FIG. 4A and FIG. 4B are schematic diagrams similar to respective FIG. 2A and FIG. 2C. The main difference between the spark plug 100 of the first embodiment, which is illustrated in FIG. 2A and FIG. 2C, and the spark plug 100*b* of the third embodiment, which is illustrated in FIG. 4A and FIG. 4B, is in a noble metal tip 38. That is, the ground electrode 30*b* of the spark plug 100*b* of the third embodiment includes the noble metal tip 38, facing the front end surface 20*s*1 of the center electrode 20. Other constitutions of the spark plug 100*b* are the same as the constitutions of the spark plug 100 of the first embodiment, which is described in FIG. 2A to FIG. 2D. Among components of the spark plug 100*b* of the third embodiment, such elements that reference numerals designate identical elements to those of the spark plug 100 of the first embodiment will not be further elaborated.

The ground electrode 30*b* includes the ground electrode 30 of the first embodiment as a main body portion (hereinafter also referred to as a "main body portion 30"). The ground electrode 30*b* further includes the noble metal tip 38 secured on the inner surface 31*si* of the front end portion 31 of the main body portion 30. The noble metal tip 38 has a columnar shape placing the central axis CL as its center. Between a surface 38*si* facing the center electrode 20 among the surface of the noble metal tip 38 (here, the surface of 38*si* at the −D1 side) and the front end surface 20*s*1 of the center electrode 20, the gap g is formed. The noble metal tip 38 is formed using an alloy containing iridium. The noble metal tip 38 is sealed to the base material 35 by laser beam welding. Specifically, a boundary part between the outer peripheral surface of the noble metal tip 38 and the inner surface 31*si* of the front end portion 31 of the main body portion 30 is sealed over the whole circumference by laser beam welding.

The schematic diagram of FIG. 4B illustrates the noble metal tip 38 welded on the inner surface 31*si*. An illustrated distance Dd8 indicates an outer diameter of the noble metal tip 38. A distance Dm8 indicates the shortest distance between the first edge line L11 and the noble metal tip 38. The ground electrode 30*b* is constituted so as to be symmetry with respect to the symmetric surface CLa. In the example of FIG. 4B, the lower bottom Lb of the opposed surface 31*tsi* of the tapered end portion 31*t* is disposed at the −D2 side with respect to the central axis CL. However, the lower bottom Lb may be disposed at the +D2 side with respect to the central axis CL.

In the spark plug 100*b* of this embodiment, in addition to between the noble metal tip 38 and the center electrode 20, discharge can also occur between the edge line(s) L11 and/or L12 and the center electrode 20. If discharge occurs between the edge line(s) L11 and/or L12 and the center electrode 20, the main body portion 30 wears. Wear of the main body portion 30 suppresses cooling of the noble metal tip 38 with the main body portion 30. In view of this, the temperature of the noble metal tip 38 is likely to be high. As a result, the noble metal tip 38 is likely to wear. Here, to promote cooling the noble metal tip 38 with the core portion 36, it is considered to increase a proportion of the core portion 36 at the front end portion 31 of the main body portion 30. However, if the core portion 36 contacts a fusion portion (details will be described later), which is generated by welding of the noble metal tip 38 and the base material 35, a strength of the welding may be degraded. Therefore, a fifth evaluation test, which will be described later, was conducted, and positions of the fusion portion and the core portion 36, balancing the wear of the noble metal tip 38 and the strength of welding, were examined.

Figure 5A:
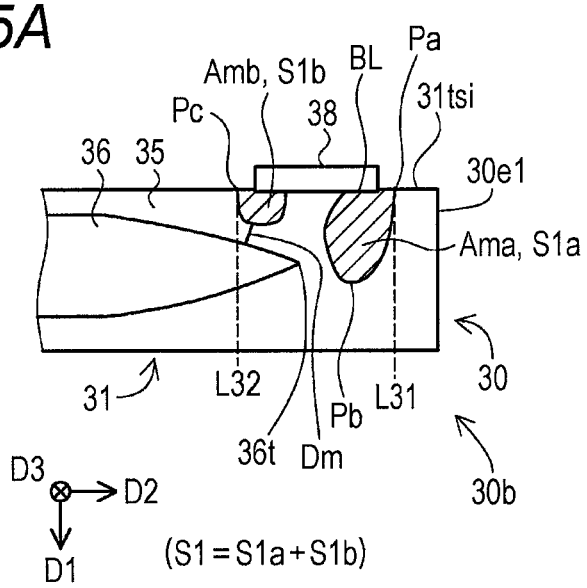
FIG. 5A and FIG. 5B are sectional views illustrating a fusion portion.
Figure 5B:
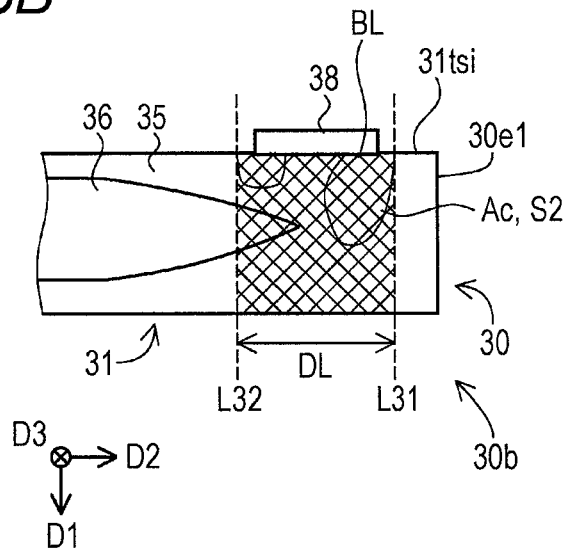
Figure 6A:
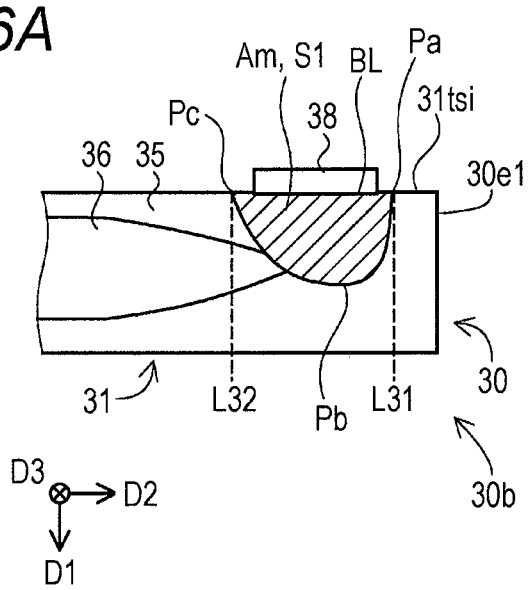
FIG. 6A and FIG. 6B are sectional views illustrating a fusion portion.
Figure 6B:
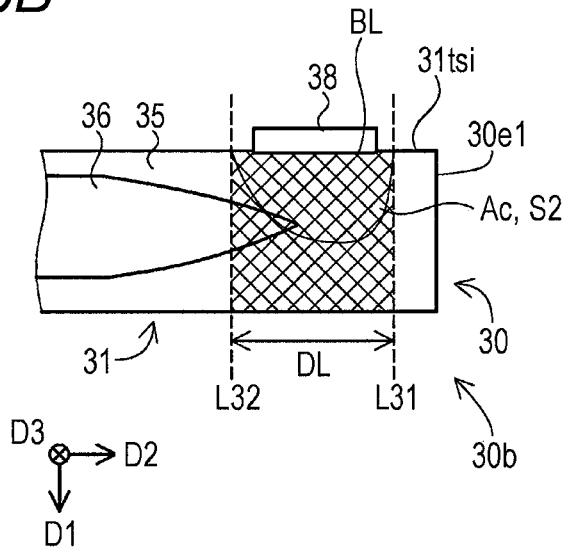

First, the following describes the halving cross section, which will be referred in the description of the fifth evaluation test. FIG. 5A and FIG. 5B and FIG. 6A and FIG. 6B are sectional views illustrating the fusion portion generated by laser beam welding. The drawings illustrate a part including the front end portion 31 among the halving cross section of the ground electrode 30*b* illustrated in FIG. 4A. FIG. 5A indicates two fusion portion cross sections Ama and Amb. FIG. 6A illustrates one fusion portion cross section Am (the fusion portion cross sections Ama, Amb, and Am are hatched). The fusion portion is a part formed by laser beam welding. The fusion portion is a part including a constituent of the base material 35 and a constituent of the noble metal tip 38. The fusion portion is formed by mixing the melted base material 35 and the melted noble metal tip 38. FIG. 5A and FIG. 5B illustrate an example where the first fusion portion cross section Ama at the front end side (the first end 30*e*1 side) is isolated from the second fusion portion cross section Amb at the rear end side. FIG. 6A and FIG. 6B illustrate an example where one continuous fusion portion cross section Am is formed at the halving cross section.

A first area S1 of FIG. 5A and FIG. 6A illustrates an area of the fusion portion cross section in the halving cross section. In the example of FIG. 5A, the first area S1 is a sum of an area S1*a* of the first fusion portion cross section Ama and an area S1*b* of the second fusion portion cross section Amb. In the example of FIG. 6A, the first area S1 is the area of the fusion portion cross section Am.

The drawings illustrate three positions Pa, Pb, and Pc. Positions of Pa, Pb, and Pc are configured based on the positions included in the fusion portion cross sections. The first position Pa is configured at the closest position to the first end 30*e*1 in the direction that the opposed surface 31*tsi* extends (here, the second direction D2). The second position Pb is configured at the farthest position from the center electrode 20 (not illustrated) in the first direction D1. The third position Pc is configured at the farthest position from the first end 30*e*1 in the direction that the opposed surface 31*tsi* extends (here, the second direction D2). The following describes the constitution of the halving cross section using these positions Pa, Pb, and Pc.

FIG. 5A and FIG. 6A illustrate two straight lines L31 and L32. The first straight line L31 is positioned at the most front end side (the first end 30*e*1 side) among the straight line perpendicular to the direction that the opposed surface 31*tsi* extends (here, the second direction D2) on the halving cross section and overlapping the fusion portion cross section. In this embodiment, the first straight line L31 passes the first position Pa and is parallel to the first direction D1. The second straight line L32 is positioned at the rearmost end side among the straight line perpendicular to the direction that the opposed surface 31*tsi* extends (here, the second direction D2) and overlapping the fusion portion cross section. In this embodiment, the second straight line L32 passes the third position Pc and is parallel to the first direction D1. A second area S2 illustrated in FIG. 5B and FIG. 6B is an area of a part sandwiched between the first straight line L31 and the second straight line L32 among the cross section of the main body portion 30 (including the fusion portion). In FIG. 5B and FIG. 6B, the parts corresponding to the second area S2 are hatched.

In the examples of FIG. 5A and FIG. 5B, the cross section of the core portion 36 extends to the front end side (the first end 30*e*1 side) of the ground electrode 30*b* with respect to the second straight line L32. The cross section of the core portion 36 (or the first core portion 36*a*1) does not contact both the fusion portion cross sections Ama and Amb. The shortest distance Dm in FIG. 5A is the shortest distance between the cross section of the core portion 36 and the fusion portion cross section. The cross section of the core portion 36 may contact at least one of the fusion portion cross sections Ama and Amb. In the example of FIG. 6A, the cross section of the core portion 36 contacts the fusion portion cross section Am. However, the cross section of the core portion 36 may be away from the fusion portion cross section Am.

C2. Fifth Evaluation Test

The following describes the fifth evaluation test using the spark plugs 100*b* of the third embodiment as samples. The fifth evaluation test measured the amount of gap distance Dg increase and observed a state of the halving cross section after operating the internal combustion engine with the spark plug 100*b* for predetermined time, similarly to the above-described second evaluation test. The ground electrode 30*b* includes the noble metal tip 38. In view of this, the amount of gap distance Dg increase was suppressed. Therefore, an operating period of the internal combustion engine was set to 300 hours, which was longer than the period in the second evaluation test. The content of the one-cycle operation was the same as the content in the second evaluation test. That is, the one-cycle operation included one-minute idling operation and one-minute wide open throttle operation. The maximum temperature of the ground electrode 30*b* during idling operation was approximately 300 degrees Celsius. The maximum temperature of the ground electrode 30*b* during wide open throttle operation was approximately 1000 degrees Celsius.

In the fifth evaluation test, 14 pieces of the spark plugs 100*b* were prepared as samples. The 14 pieces of samples were divided into two groups. The two groups differed in the dimensions of the main body portion 30 and the diameter of the noble metal tip 38 from one another. As described later, the number of samples of the first group was "8" while the number of samples of the second group was "6". In both samples, the material of the base material 35 was Inconel and the material of the core portion 36 was a pure copper. The following lists dimensions common within the respective groups (for reference numerals of the respective dimensions, see FIG. 4A and FIG. 4B, FIG. 5A and FIG. 5B, and FIG. 6A and FIG. 6B).

<First Group>

1) Width Da of the first end 30*e*1 of the tapered end portion 31*t* in the third direction D3: 1.2 mm This width Da was the same length as the length of the upper bottom Ub of the opposed surface 31*tsi*.

2) Length Db of the tapered end portion 31*t* in the D2 direction: 2.5 mm

3) Width Dc of the front end portion 31 (excluding the tapered end portion 31*t*) in the third direction D3: 2.8 mm This width Dc was the same length as the length of the lower bottom Lb of the opposed surface 31*tsi*.

4) Thickness Dt of the front end portion 31 in the first direction D1: 1.6 mm 5) Outer diameter Ddb of the noble metal tip 38: 1.0 mm 6) Distance DL between the two straight lines L31 and L32: 1.6 mm 7) Shortest distance Dm8 between the noble metal tip 38 and the edge line L11: 0.4 mm 8) Diameter Dd of the front end surface 20*s*1 of the center electrode 20: 0.8 mm 9) Distance Dsb between the lower bottom Lb and the central axis CL of the front end surface 20*s*1 in the second direction D2: 1.0 mm The lower bottom Lb was disposed at the −D2 side with respect to the central axis CL of the front end surface 20*s*1.

10) Gap distance Dg: 1.0 mm

11) Distance corresponding to the edge distance De of FIG. 2D: 1.2 mm

<Second Group>

1) Width Da of the first end 30*e*1 of the tapered end portion 31*t* in the third direction D3: 1.0 mm This width Da was the same length as the length of the upper bottom Ub of the opposed surface 31*tsi*.

2) Length Db of the tapered end portion 31*t* in the D2 direction: 2.0 mm

3) Width Dc of the front end portion 31 (excluding the tapered end portion 31*t*) in the third direction D3: 2.2 mm This width Dc was the same length as the length of the lower bottom Lb of the opposed surface 31*tsi*.

4) Thickness Dt of the front end portion 31 in the first direction D 1: 1.1 mm 5) Outer diameter Ddb of the noble metal tip 38: 1.2 mm 6) Distance DL between the two straight lines L31 and L32: 1.8 mm 7) Shortest distance Dm8 between the noble metal tip 38 and the edge line L11: 0.3 mm 8) Diameter Dd of the front end surface 20*s*1 of the center electrode 20: 0.6 mm 9) Distance Dsb between the lower bottom Lb and the central axis CL of the front end surface 20*s*1 in the second direction D2: 0.5 mm The lower bottom Lb was disposed at the −D2 side with respect to the central axis CL of the front end surface 20*s*1.

10) Gap distance Dg: 1.0 mm

11) Distance corresponding to the edge distance De of FIG. 2D: 1.2 mm

The distance corresponding to the shortest distance Wm of FIG. 2B was 0.2 mm or more to 1.5 mm or less in all samples.

Table 4, which will be illustrated below, lists respective constitutions and evaluation results of the eight pieces of samples (No. 1 to No. 8) in the first group. Table 5 lists respective constitutions and evaluation results of the six pieces of samples (No. 9 to No. 14) in the second group.

TABLE 4

| No. | S1 | S2 | Sr (S1/S2) | Dm | Core position | Evaluation on peeling | dDg | Evaluation on wear |
|---|---|---|---|---|---|---|---|---|
| 1 | 0.5 | 2.56 | 0.195 | 0.2 | Between Pb and Pc | A | 0.15 | A |
| 2 | 0.5 | 2.56 | 0.195 | 0 | Contact | B (peeled) | — | — |
| 3 | 0.7 | 2.56 | 0.273 | 0.8 | Near side with respect to Pc | A | 0.22 | B |
| 4 | 0.7 | 2.56 | 0.273 | 0.6 | Immediately below of Pc | A | 0.18 | A |
| 5 | 0.7 | 2.56 | 0.273 | 0.2 | Between Pb and Pc | A | 0.15 | A |
| 6 | 0.7 | 2.56 | 0.273 | 0 | Contact | B | 0.14 | A |
| 7 | 0.9 | 2.56 | 0.352 | 0.2 | Between Pb and Pc | A | 0.23 | B |
| 8 | 0.9 | 2.56 | 0.352 | 0 | Contact | A | 0.17 | A |

TABLE 5

| No. | S1 | S2 | Sr (S1/S2) | Dm | Core position | Evaluation on peeling | dDg | Evaluation on wear |
|---|---|---|---|---|---|---|---|---|
| 9 | 0.5 | 1.98 | 0.253 | 0.2 | Between Pb and Pc | A | 0.15 | A |
| 10 | 0.5 | 1.98 | 0.253 | 0 | Contact | B (peeled) | — | — |
| 11 | 0.7 | 1.98 | 0.354 | 0.2 | Between Pb and Pc | A | 0.22 | B |
| 12 | 0.7 | 1.98 | 0.354 | 0 | Contact | A | 0.16 | A |
| 13 | 0.9 | 1.98 | 0.455 | 0.2 | Between Pb and Pc | A | 0.24 | B |
| 14 | 0.9 | 1.98 | 0.455 | 0 | Contact | A | 0.17 | A |

Table 4 and Table 5 list sample numbers, the first areas S1, the second areas S2, area ratios Sr, the shortest distances Dm, core positions, evaluations on peeling, the amount of gap increase dDg, and evaluations on wear. The area ratio Sr is a ratio dividing the first area S1 by the second area S2. "Core position" indicates the position of the front end 36*t* of the core portion 36 at the halving cross section (FIG. 5A and FIG. 5B, and FIG. 6A and FIG. 6B). "Between Pb and Pc" indicates that the position of the front end 36*t* in the second direction D2 is at between the second position Pb and the third position Pc (namely, the second straight line L32). "Contact" indicates that the cross section of the core portion 36 contacts the fusion portion cross section. "Near side with respect to Pc" indicates that the position of the front end 36*t* in the second direction D2 was at the −D2 side with respect to the third position Pc (namely, the second straight line L32). "Immediately below of Pc" indicates that the front end 36*t* was disposed on the second straight line L32.

Regarding the evaluation on peeling, Evaluation A indicates that a length of an oxidized part generated at a boundary line BL between the noble metal tip 38 and the base material 35 at the halving cross section illustrated in FIG. 5A and FIG. 6A was less than 50% with respect to the length of the boundary line BL, and Evaluation B indicates that the length of the oxidized part was 50% or more with respect to the length of the boundary line BL or the noble metal tip 38 was peeled off from the base material 35. As listed in Table 4 and Table 5, peeling occurred in the sample No. 2 and the sample No. 10. In the sample No. 6, peeling did not occur but the length of the oxidized part was 50% or more with respect to the length of the boundary line BL. Regarding the evaluation on wear, Evaluation A indicates that the amount of gap increase dDg was less than 0.2 mm, and Evaluation B indicates that the amount of gap increase dDg was 0.2 mm or more. This threshold of 0.2 mm was smaller than a threshold of 0.3 mm of the second evaluation test. That is, the fifth evaluation test conducted the evaluation on wear under the severe condition compared with the second evaluation test.

As listed in Table 4 and Table 5, a plurality of the samples in the same group can be different in the first area S1, the shortest distance Dm, and the core position. The change in the first area S1 was achieved by adjusting a condition of laser beam welding (for example, irradiation time of laser light). The changes in the shortest distance Dm and the core position were achieved by adjusting the condition of laser beam welding and a condition of forming the ground electrode 30*b*. The constitutions of the halving cross section of the respective samples can be a type illustrated in FIG. 5A or a type illustrated in FIG. 6A according to the first area S1 or a similar condition.

Figure 7:
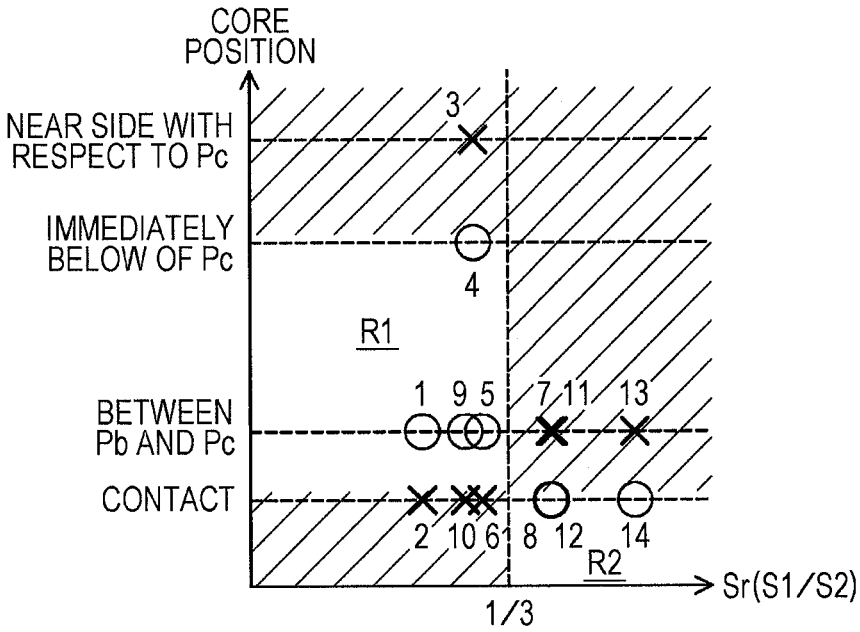
FIG. 7 is a graph illustrating results of evaluation tests.

FIG. 7 is a graph summarizing the results listed in Table 4 and Table 5. The horizontal axis indicates the area ratio Sr (S1/S2). The vertical axis indicates the outline of the core position. The circles in the drawing indicate samples where both the evaluation on peeling and the evaluation on wear were Evaluation A. The X marks indicate samples where at least one of the evaluation on peeling and the evaluation on wear was Evaluation B. Numbers attached near the marks indicate sample numbers of the marks.

First, the following describes the case where the area ratio Sr was smaller than 1/3. As indicated by the sample No. 2, the sample No. 6, and the sample No. 10, the evaluation on peeling is Evaluation B when the area ratio Sr is smaller than 1/3 and the cross section of the core portion 36 contacts the fusion portion cross section. This is probably due to the following reason. That is, in the case where the area ratio Sr is small, the fusion portion cross section is relatively small. In view of this, the strength of welding becomes weak. Furthermore, by contact of the core portion 36 with the fusion portion, the constituent of the core portion 36 is further contained in the fusion portion. This possibly results in degrade of the strength of the fusion portion. This is likely to promote wear at the boundary part between the noble metal tip 38 and the base material 35 (for example, oxidation).

As indicated by the sample No. 3, in the case where the area ratio Sr was smaller than 1/3 and the front end 36*t* of the core portion 36 was disposed at the near side with respect to the third position Pc, the evaluation on wear was Evaluation B. This is probably due to the following reason. That is, the core portion 36 is not disposed at the front end side with respect to the second straight line L32. In view of this, the temperature of the front end portion 31 is likely to become high. As a result, the noble metal tip 38 is likely to wear.

The sample No. 1, the sample No. 4, the sample No. 5, and the sample No. 9 had the area ratio Sr smaller than 1/3. Moreover, the cross section of the core portion 36 did not contact the fusion portion cross section. Furthermore, the front end 36*t* of the core portion 36 was disposed at the front end side with respect to the third position Pc (that is, the first end 30*e*1 side with respect to the second straight line L32). In this case, both the evaluation on peeling and the evaluation on wear were Evaluation A. Thus, in the case where the area ratio Sr is smaller than 1/3, it is preferred that the cross section of the core portion 36 do not contact the fusion portion cross section and the front end 36*t* of the core portion 36 is disposed at the first end 30*e*1 side with respect to the second straight line L32. FIG. 7 illustrates a preferable constitution range of R1 by unhatched region.

Next, the following describes the case where the area ratio Sr was 1/3 or more. The sample No. 7, the sample No. 11, and the sample No. 13 had the area ratio Sr of 1/3 or more. Furthermore, the front end 36*t* of the core portion 36 was disposed between the second position Pb and the third position Pc (that is, the cross section of the core portion 36 was away from the fusion portion cross section). In this case, the evaluation on wear was Evaluation B. This is probably due to the following reason. That is, the fusion portion contains the constituent of the noble metal tip 38 in addition to the constituent of the base material 35. Therefore, thermal conductivity of the fusion portion can be lower than thermal conductivity of the base material 35. In the case where the area ratio Sr is large, the fusion portion cross section become relatively large while the cross section of the base material 35 excluding the fusion portion become relatively small. Therefore, an effect of cooling the front end portion 31 with the base material 35 becomes small. As the results described above, the temperature of the front end portion 31 is likely to become high. In view of this, the noble metal tip 38 is likely to wear.

The sample No. 8, the sample No. 12, and the sample No. 14 had the area ratio Sr of 1/3 or more. Furthermore, the cross section of the core portion 36 contacted the fusion portion cross section. In this case, both the evaluation on peeling and the evaluation on wear were Evaluation A. This is probably due to the following reason. That is, large area ratio Sr strengthens the welding strength. Therefore, even if the fusion portion contains the constituent of the core portion 36 due to contact of the cross section of the core portion 36 with the fusion portion cross section, a sufficient welding strength can be achieved between the noble metal tip 38 and the base material 35. Although the area ratio Sr is large, the cross section of the core portion 36 contacts the fusion portion cross section. This allows improving an effect of cooling the front end portion 31 with the core portion 36. This allows suppressing wear of the noble metal tip 38. Thus, in the case where the area ratio Sr is 1/3 or more, it is preferred that the cross section of the core portion 36 contact the fusion portion cross section. FIG. 7 illustrates a preferable constitution range of R2 by unhatched region.

Generally, in the case where the front end 36*t* of the core portion 36 is disposed at the first end 30*e*1 side with respect to the second straight line L32, compared with the different case, an effect of cooling the front end portion 31 with the core portion 36 is high. In the case where the area ratio Sr is comparatively small, compared with the case where the area ratio Sr is comparatively large, degrade of thermal conductivity of the ground electrode 30*b* can be suppressed. Here, isolating the core portion 36 from the fusion portion allows suppressing degrade of the sealing strength between the noble metal tip 38 and the base material 35. In the case where the area ratio Sr is comparatively large, compared with the case where the area ratio Sr is comparatively small, the sealing strength between the noble metal tip 38 and the base material 35 can be strengthened. Here, contact of the core portion 36 with the fusion portion allows suppressing degrade of thermal conductivity of the ground electrode 30*b*. The above-described various characteristics can be achieved regardless of the respective dimensions of various components of the ground electrode 30*b* and/or the constitution of the core portion 36. Therefore, it is inferred that the preferable constitution of the halving cross section is not limited to the spark plug samples employed in the fifth evaluation test, but is applicable to various spark plugs. For example, the preferable constitution may be applied to a spark plug that includes the ground electrode 30*a* (FIG. 3A) and the noble metal tip 38 secured to the ground electrode 30*a*. In this case, the ground electrode 30*a* in FIG. 3A corresponds to the main body portion of the ground electrode.

D. Modification (1) Constitutions of the ground electrode are not limited to the constitutions of the respective embodiments, but can employ various constitutions. For example, at least one of the tapered surfaces 31*ts*1 and 31*ts*2 may not be parallel to but may be inclined with respect to the central axis CL. For example, the two tapered surfaces 31*ts*1 and 31*ts*2 may be inclined with respect to the central axis CL so that a distance between the two tapered surfaces 31*ts*1 and 31*ts*2 (a distance parallel to the third direction D3) gradually increases to the first direction D1.

The materials of components of the ground electrodes 30, 30*a*, and 30*b* are not limited to the above-described materials, but various materials are applicable. For example, the materials of the base materials 35 and 35*a* are not limited to Inconel, but various materials excellent in thermal resistance, such as other nickel alloys or a pure nickel are applicable.

(2) The material of the noble metal tip 38 is not limited to an alloy containing an iridium, but a material containing other various noble metals (for example, a platinum) is applicable. The center electrode 20 may include a noble metal tip forming the gap g.

(3) Constitutions of the spark plug are not limited to the constitutions of the respective embodiments but various constitutions are applicable. For example, the outer diameter Dd of the front end surface 20*s*1 of the center electrode 20 may be larger than the widths of the ground electrode 30, 30*a*, and 30*b* (a width in the direction vertical to the direction that the ground electrode extends) when viewed facing the direction parallel to the central axis CL. In any cases, when viewed facing the direction parallel to the central axis CL, a part of the front end surface 20*s*1 of the center electrode 20 may be disposed outside of a range overlapped with the ground electrode 30, 30*a*, and 30*b*. In the respective embodiments, the lower bottom Lb of the opposed surface 31*tsi* of the tapered end portion 31*t* may be disposed at the +D2 side of the central axis CL or may be disposed at the −D2 side of the central axis CL.

The embodiments of this disclosure are described above based on the working examples and modifications. The above-described embodiments are for ease of understanding of this disclosure and do not limit this disclosure. This disclosure may be modified or improved without departing from the gist of the invention. This disclosure also includes the equivalents.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A sparkplug, comprising:

a center electrode extending in an axial direction;

an insulator with an axial hole extending in the axial direction, the center electrode being disposed to be inserted into the axial hole;

a metal shell disposed at an outer circumference of the insulator; and a ground electrode that electrically connects to the metal shell, the ground electrode forming a gap with a front end surface of the center electrode, wherein the ground electrode includes a rod-shaped main body portion, the main body portion including a base material and a core portion, the base material forming at least a part of a surface of the ground electrode, the core portion being buried in the base material and having a higher thermal conductivity than the base material, a front end portion of the main body portion of the ground electrode is disposed at a position facing a front end surface of the center electrode, the front end portion of the main body portion includes a tapered front end portion, the tapered front end portion including an opposed surface and a pair of tapered surfaces, the opposed surface being a surface facing the center electrode, the tapered surfaces being configured to sandwich the opposed surface, when the front end surface of the center electrode is projected along the axial direction, at least a part of the tapered end portion is disposed in a range overlapping the projected front end surface of the center electrode, a shortest distance between the center electrode and a boundary formed by the opposed surface and the tapered surface is equal to or less than 1.2 times a distance of the gap, and a perpendicular cross section of the ground electrode includes a front end of the core portion perpendicular to the axial direction, wherein at least a part of a cross section of the core portion is disposed in a region at a front end side of a straight line that passes a rear end of a line segment corresponding to the tapered surface and is vertical to the line segment, and a shortest distance between the line segment and the cross section of the core portion is 0.2 mm or more to 1.5 mm or less.

2. The spark plug according to claim 1, wherein at least a part including the front end of the core portion is formed of a material with a melting point of 1350 degrees Celsius or more.

3. The spark plug according to claim 2, wherein the core portion includes a first core portion and a second core portion, the first core portion having a higher thermal conductivity than the base material, the second core portion being disposed between the base material and the first core portion and having a higher thermal conductivity than the first core portion, on the perpendicular cross section, a cross-sectional structure of a front end side of the ground electrode is a two-layered structure of the first core portion and the base material, a cross-sectional structure of a rear end side of the ground electrode being a three-layered structure of the first core portion, the second core portion, and the base material.

4. The spark plug according to claim 3, wherein the ground electrode further includes a noble metal tip, the noble metal tip facing a front end surface of the center electrode.

5. The spark plug according to claim 2, wherein the ground electrode further includes a noble metal tip, the noble metal tip facing a front end surface of the center electrode.

6. The spark plug according to claim 1, wherein the ground electrode further includes a noble metal tip, the noble metal tip facing a front end surface of the center electrode.

7. The spark plug according to claim 6, wherein the noble metal tip is secured to the base material, the main body portion of the ground electrode includes a fusion portion, the fusion portion including a constituent of the base material and a constituent of the noble metal tip, a dividing cross section that is perpendicular to the opposed surface has a line that uniformly divides the opposed surface into two, the line extending on the opposed surface in a cross section of the ground electrode along a longitudinal direction of the ground electrode, wherein among straight lines perpendicular to a direction where the opposed surface extends and overlap a cross section of the fusion portion, a straight line at a most front end side is referred to as a first straight line and a straight line at a rearmost end side is referred to as a second straight line, an area of the cross section of the fusion portion is referred to as a first area S1, on a cross section of the main body portion of the ground electrode, an area of a part sandwiched between the first straight line and the second straight line is referred to as a second area S2, an area ratio S1/S2 is less than 1/3, a cross section of the core portion extends to a front end side of the ground electrode with respect to the second straight line, and the cross section of the core portion is away from a cross section of the fusion portion.

8. The spark plug according to claim 6, wherein the noble metal tip is secured to the base material, the main body portion of the ground electrode includes a fusion portion, the fusion portion including a constituent of the base material and a constituent of the noble metal tip, a dividing cross section that is perpendicular to the opposed surface has a line that uniformly divides the opposed surface into two, the line extending the opposed surface in a cross section of the ground electrode along a longitudinal direction of the ground electrode, wherein among straight lines perpendicular to a direction where the opposed surface extends and overlap a cross section of the fusion portion, a straight line at a most front end side is referred to as a first straight line and a straight line at a rearmost end side is referred to as a second straight line, an area of the cross section of the fusion portion is referred to as a first area S1, on a cross section of the main body portion of the ground electrode, an area of a part sandwiched between the first straight line and the second straight line is referred to as a second area S2, an area ratio S1/S2 is 1/3 or more, and a cross section of the core portion contacts the cross section of the fusion portion.

* * * * *